US009046841B2

(12) United States Patent
Amita et al.

(10) Patent No.: US 9,046,841 B2
(45) Date of Patent: Jun. 2, 2015

(54) GLOSS APPLICATOR AND IMAGE FORMING APPARATUS INCLUDING SAME

(71) Applicants: Akiyasu Amita, Kanagawa (JP); Hiroyuki Shimada, Kanagawa (JP)

(72) Inventors: Akiyasu Amita, Kanagawa (JP); Hiroyuki Shimada, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/677,579

(22) Filed: Nov. 15, 2012

(65) Prior Publication Data

US 2013/0149017 A1 Jun. 13, 2013

(30) Foreign Application Priority Data

Dec. 12, 2011 (JP) ..... 2011-271079

(51) Int. Cl.
*G03G 15/00* (2006.01)
*G03G 15/20* (2006.01)

(52) U.S. Cl.
CPC ..... *G03G 15/2078* (2013.01); *G03G 15/6585* (2013.01); *G03G 2215/00805* (2013.01); *G03G 15/2039* (2013.01)

(58) Field of Classification Search
CPC ..... G03G 15/6585; G03G 15/2078; G03G 15/2039; G03G 2215/00805
USPC ..... 399/69, 341
See application file for complete search history.

(56) References Cited

U.S. PATENT DOCUMENTS 5,099,288 A * 3/1992 Britto et al. ..... 399/320
2003/0165348 A1 9/2003 Amita et al.
2004/0245241 A1 12/2004 Kishi et al.
2004/0247332 A1 12/2004 Kishi et al.
2004/0247334 A1 12/2004 Kishi et al.
2004/0258426 A1 12/2004 Kishi et al.
2005/0139584 A1 6/2005 Kishi et al.

(Continued)

FOREIGN PATENT DOCUMENTS

JP 5-333643 12/1993
JP 2004-325934 11/2004

(Continued)

OTHER PUBLICATIONS

U.S. Appl. No. 13/480,555, filed May 25, 2012, Hiroyuki Kunii, et al.

(Continued)

*Primary Examiner* — Ryan Walsh
*Assistant Examiner* — Philip Marcus T Fadul
(74) *Attorney, Agent, or Firm* — Oblon, McClelland, Maier & Neustadt, L.L.P.

(57) ABSTRACT

A gloss applicator includes a heater member to be heated by a heat source; an endless belt to rotate while being heated by the heater member; a pressure member that presses against the heater member via the endless belt, thereby forming a nip; a cooling unit to cool the endless belt, wherein a recording medium on which a toner image is formed is conveyed into the nip, the recording medium is further conveyed from the nip while being in contact with the endless belt to be cooled by the cooling unit and separated from the endless belt; a temperature sensor configured to detect a surface temperature of the endless belt, disposed between the separating position of the recording medium and a heating position by the heater member; and a cooling controller to control the cooling unit to vary a cooling amount based on a temperature detected by the temperature sensor.

9 Claims, 4 Drawing Sheets

(56) References Cited

U.S. PATENT DOCUMENTS

| | | | | |
|---|---|---|---|---|
| 2005/0175368 | A1 | 8/2005 | Matsusaka et al. | |
| 2005/0175370 | A1 | 8/2005 | Matsusaka et al. | |
| 2005/0191078 | A1 | 9/2005 | Kishi et al. | |
| 2006/0029411 | A1 | 2/2006 | Ishii et al. | |
| 2006/0039713 | A1 | 2/2006 | Kishi et al. | |
| 2006/0039725 | A1* | 2/2006 | Wu et al. | 399/329 |
| 2006/0051111 | A1 | 3/2006 | Kishi et al. | |
| 2006/0051112 | A1 | 3/2006 | Matsusaka et al. | |
| 2006/0051113 | A1 | 3/2006 | Kishi et al. | |
| 2006/0051119 | A1 | 3/2006 | Kishi et al. | |
| 2006/0051120 | A1 | 3/2006 | Kishi et al. | |
| 2006/0051121 | A1 | 3/2006 | Matsusaka et al. | |
| 2006/0127118 | A1 | 6/2006 | Kishi et al. | |
| 2006/0165443 | A1 | 7/2006 | Yoshinaga et al. | |
| 2006/0177232 | A1 | 8/2006 | Ehara et al. | |
| 2006/0182460 | A1 | 8/2006 | Kishi et al. | |
| 2006/0257183 | A1 | 11/2006 | Ehara et al. | |
| 2007/0014600 | A1 | 1/2007 | Ishii et al. | |
| 2007/0031159 | A1 | 2/2007 | Kishi et al. | |
| 2007/0036573 | A1 | 2/2007 | Kishi et al. | |
| 2007/0212090 | A1 | 9/2007 | Matsusaka et al. | |
| 2008/0145088 | A1 | 6/2008 | Matsusaka et al. | |
| 2009/0123172 | A1 | 5/2009 | Kishi et al. | |
| 2009/0274477 | A1 | 11/2009 | Okamoto et al. | |
| 2009/0274494 | A1 | 11/2009 | Okamoto et al. | |
| 2009/0274495 | A1 | 11/2009 | Okamoto et al. | |
| 2009/0274496 | A1 | 11/2009 | Okamoto et al. | |
| 2009/0274497 | A1 | 11/2009 | Okamoto et al. | |
| 2009/0274498 | A1 | 11/2009 | Okamoto et al. | |
| 2009/0317113 | A1 | 12/2009 | Kishi et al. | |
| 2010/0129107 | A1* | 5/2010 | Takehara et al. | 399/92 |
| 2011/0064494 | A1 | 3/2011 | Amita et al. | |
| 2011/0085815 | A1 | 4/2011 | Kishi et al. | |
| 2011/0129248 | A1* | 6/2011 | Shiozawa | 399/82 |
| 2011/0176822 | A1* | 7/2011 | Ishii et al. | 399/45 |
| 2011/0188911 | A1 | 8/2011 | Kunii et al. | |
| 2012/0008153 | A1 | 1/2012 | Kunii et al. | |
| 2012/0070180 | A1* | 3/2012 | Iijima et al. | 399/92 |
| 2012/0201579 | A1 | 8/2012 | Kunii et al. | |
| 2012/0224898 | A1* | 9/2012 | Amita et al. | 399/341 |

FOREIGN PATENT DOCUMENTS

| | | |
|---|---|---|
| JP | 2006-243444 | 9/2006 |
| JP | 2009-014876 | 1/2009 |

OTHER PUBLICATIONS

U.S. Appl. No. 13/454,671, filed Apr. 24, 2012, Hiroyuki Kunii, et al.
U.S. Appl. No. 13/537,912, filed Jun. 29, 2012, Satoshi Muramatsu, et al.
U.S. Appl. No. 13/471,878, filed May 15, 2012, Hiroyuki Kunii, et al.
U.S. Appl. No. 13/528,015, filed Jun. 20, 2012, Akiyasu Amita, et al.

* cited by examiner

GLOSS APPLICATOR AND IMAGE FORMING APPARATUS INCLUDING SAME

CROSS-REFERENCE TO RELATED APPLICATION

The present application claims priority from Japanese patent application number 2011-271079, filed on Dec. 12, 2011, the entire disclosure of which is incorporated by reference herein.

BACKGROUND OF THE INVENTION

1. Field of the Invention

The present invention relates to a gloss applicator and an image forming apparatus including the gloss applicator. More specifically, the present invention relates to an image forming apparatus employing an electrophotographic method, such as a copier, a printer, a facsimile machine, or a multi-function apparatus having one or more capabilities of the above devices, and relates to a gloss applicator to apply glossiness to a toner image formed by any of the above-type image forming apparatuses.

2. Description of the Related Art

In an image forming apparatus using the electrophotographic method, a toner image is obtained using toner formed of thermally fusible resins and the like. The unfixed toner image transferred to a recording material (such as a recording medium, recording sheet, or simply a sheet) needs to be fixed thereon, so the image forming apparatus includes a fixing device for fixing the toner image onto the sheet with heat and pressure.

For example, a generally used fixing device employing a two-roller method includes a heat roller including a built-in heater and a pressure roller, the two rollers forming a nip portion to which the recording medium on which an unfixed toner image is transferred is conveyed and subjected to heat and pressure by the heat roller and the pressure roller to soften and fuse the toner of the unfixed toner image. The recording medium upon passing through the nip portion is then cooled and the toner is stiffened and fixed onto the surface of the recording medium. However, the toner image obtained through the above-configured fixing device does not show a sufficient glossiness, which has been a problem.

Various technologies have been proposed for a gloss applicator to make the toner image formed on the recording medium a high-quality image with an appropriate gloss during or after fixation by the fixing device. Thus, a fixing device including a gloss applicator or a fixing device capable of obtaining a high-quality print is disclosed in following patent documents: JP-2009-14876-A; JP-2004-325934-A; JP-H05-333643-A; and JP-2006-243444-A. Each of the disclosed fixing devices includes an endless belt stretched between a fixing roller and a support roller, and a pressure roller so disposed as to oppose the fixing roller, and further a gloss applicator to cool the recording sheet being in contact with the endless belt, after which the recording sheet is then separated from the endless belt to obtain a high-gloss print.

As a cooling means to cool the endless belt and the recording sheet that has been in contact with the endless belt, JP-2009-14876-A discloses a method to dispose cooling fans at an inner side of the endless belt and an external side of the endless belt to cool the belt by sending air from the cooling fan. The same also discloses a method to cool the endless belt by bringing it into contact with a heat pipe or a heatsink including water or other refrigerant.

Similarly, JP-2004-325934-A discloses a method to cool the endless belt by using a heat radiating member (such as a heatsink) to absorb and radiate heat by contacting an inner surface of the endless belt or by using a cooling device such as a cooling fan. JP-H05-333643-A discloses a method to cool the endless belt by disposing a cooling fan beneath the endless belt and by sending air from the cooling fan to the endless belt. The same discloses adjusting the air amount of the cooling fan.

Further, JP-2006-243444-A discloses a fixing device to heat a cooling member for the purpose of shortening a warm-up time. The disclosed apparatus includes a temperature adjusting mode in which the endless belt is controlled to rotate at a faster speed at start-up than during normal operation.

The gloss applicator of the belt type is configured such that the toner on the recording medium is once fused at a nip portion, the toner on the recording medium and the endless belt are pressed together, and the recording medium is conveyed and cooled in the contacting state and separated from the endless belt. As a result, the surface state of the endless belt is transferred to the surface of the toner so that the toner surface becomes smooth and a highly glossy print can be obtained. Accordingly, to obtain a high gloss image, the endless belt (that is, the toner surface) needs to be cooled to a desired temperature in a state in which the toner and the endless belt are closely contacted. Therefore, cooling property and cooling efficiency of the cooling means are important.

However, the above-described technologies do not sufficiently cool the endless belt to the desired temperature because an image forming apparatus with a higher printing speed in which the endless belt is driven at a higher speed does not have enough time to cool the belt.

In the cooling method using the cooling fan, because in the continuous printing the heater section of the heat roller of the endless belt radiates heat to increase an environmental temperature, the ventilation air is heated and the temperature of the belt gradually increases.

Even in the heatsink method to cool the endless belt while contacting it, because in the continuous printing the heater section of the heat roller of the endless belt radiates heat to increase an environmental temperature and causes the ventilation air to be heated, the temperature of the belt gradually increases so that the endless belt cannot be cooled to a desired temperature.

Further, in the heater section, the endless belt after having been cooled by the cooling means must be reheated to a predetermined temperature using only that portion of the belt that is wound around the fixing roller or the heating roller. However, if the cooling means is not sufficiently heated immediately after the initial activation of the machine or in a low temperature environment, the amount of electric power required for heating the heater section increases, as does the maximum electric power during printing. The power consumption of high-speed machines in particular increases.

To cope with this disadvantage, JP-2006-243444-A discloses an approach in which the endless belt is rotated faster than during normal operation and the cooling means is heated. However, achieving both good cooling and reduced power consumption simultaneously remains a challenge.

SUMMARY OF THE INVENTION

The present invention provides an optimal gloss applicator having a heat source; a heater member to be heated by the heat source; an endless belt to rotate while being heated by the heater member; a pressure member that presses against the heater member via the endless belt, thereby forming a nip; and a cooling unit to cool the endless belt. A recording medium on which a toner image is formed is conveyed into the nip, the recording medium is then further conveyed from the nip while being in contact with the endless belt to be cooled by the cooling unit and separated from the endless belt. The gloss applicator further includes a temperature sensor and a cooling controller. The temperature sensor is disposed at any position between the separating position of the recording medium in the rotation direction of the endless belt and a heating position by the heater member, and is configured to detect a surface temperature of the endless belt. The cooling controller controls the cooling unit to vary a cooling amount based on a temperature detected by the temperature sensor.

These and other objects, features, and advantages of the present invention will become apparent upon consideration of the following description of the preferred embodiments of the present invention when taken in conjunction with the accompanying drawings.

DESCRIPTION OF THE PREFERRED EMBODIMENTS

Hereinafter, preferred embodiments of the present invention will now be described in detail with reference to the accompanying drawings from FIG. 1 to FIG. 6.

Figure 1:
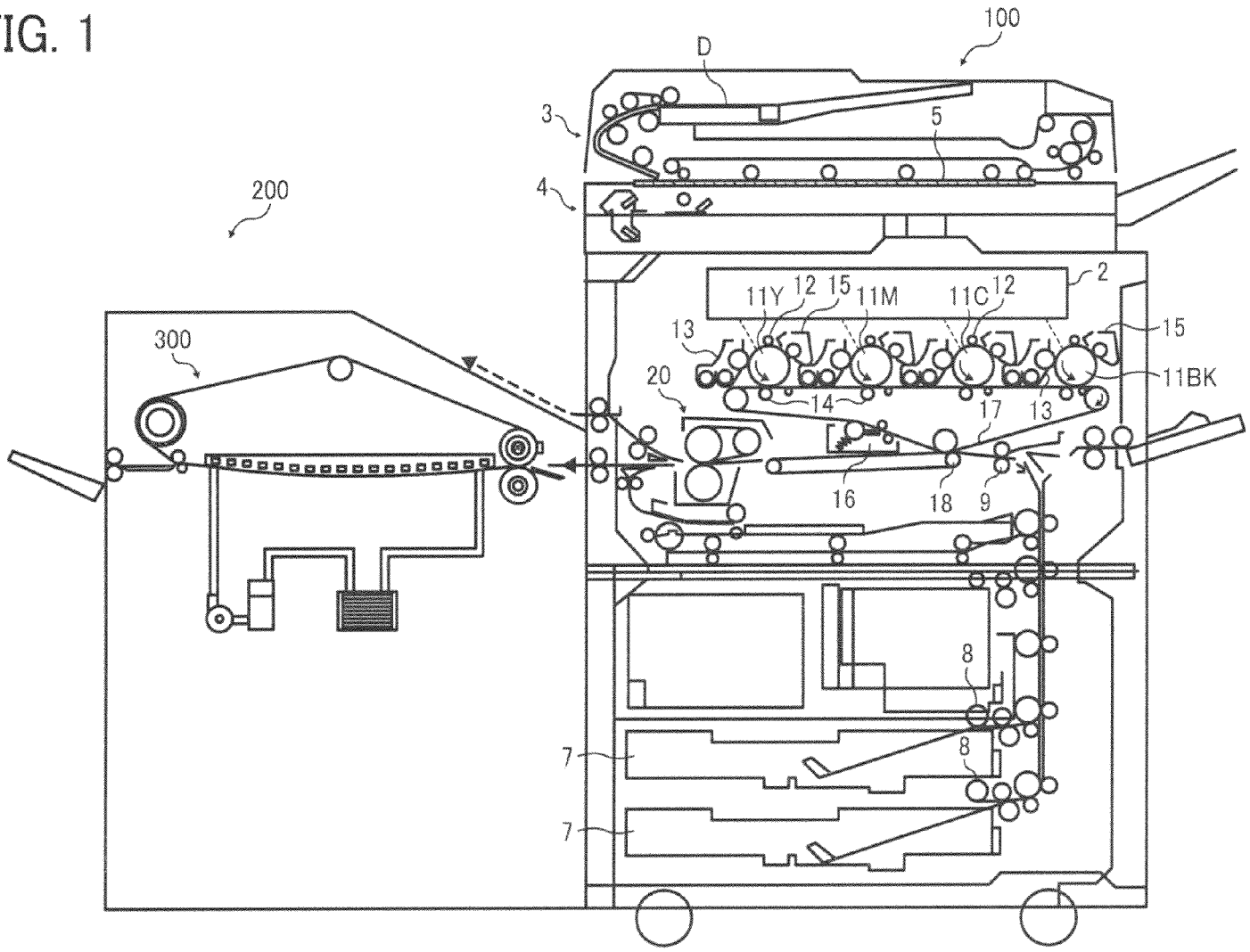
FIG. 1 is a schematic view of an image forming apparatus and a gloss applicator according to an embodiment of the present invention.

FIG. 1 is a schematic view of an image forming apparatus 100 and a gloss applicator unit 200 according to an embodiment of the present invention. In addition, FIG. 1 is a schematic view illustrating a state in which the gloss applicator unit 200 including a gloss applicator 300 is attached to the image forming apparatus 100. In the embodiment as illustrated in FIG. 1, the gloss applicator 300 is included in the gloss applicator unit 200 and is attached to the main body of the image forming apparatus 100 as a separate device, but the gloss applicator 300 need not necessarily be a separate apparatus and can be installed inside the main body of the image forming apparatus 100 in the downstream of the fixing device.

The structure and operation of the image forming apparatus will now be described.

As illustrated in FIG. 1, the image forming apparatus 100 is a tandem-type color copier and includes: a writing section 2 to emit laser beams based on input image data; a document feeder 3 to feed a document D to a document reader 4, the document reader 4 reading image data of the document D; sheet feed trays 7 in which recording media P such as transfer sheets are stacked; a registration roller pair 9 to adjust conveyance timing of the recording media P; photoreceptor drums 11Y, 11M, 11C, and 11BK, on each of which a toner image of a corresponding color (yellow, magenta, cyan, and black) is formed; a charger 12 to charge a surface of each photoreceptor drum 11Y, 11M, 11C, or 11BK; a developing device 13 to develop an electrostatic latent image formed on each photoreceptor drum 11Y, 11M, 11C, or 11BK to render the latent image visible; a transfer bias roller (or a primary transfer bias roller) 14 to transfer a toner image formed on each photoreceptor drum 11Y, 11M, 11C, or 11BK onto the recording medium P in a superimposed manner; a cleaner 15 to collect and store residual toner remaining on the photoreceptor drums 11Y, 11M, 11C, and 11BK; an intermediate transfer belt 17 on which a plurality of colors of toner images are transferred in the superimposed manner; an intermediate transfer belt cleaner 16 to clean the intermediate transfer belt 17; a secondary transfer bias roller 18 to transfer the color toner image on the intermediate transfer belt 17 to the recording medium P; and a fixing device 20 to fix the toner image (that is, the unfixed image) onto the recording medium P.

Further, a reference numeral 300 is a peripheral device externally attached to the main body of the image forming apparatus 100 and represents a gloss applicator to apply a gloss to the toner image carried on the recording medium P. Further, the gloss applicator 300 improves glossy property of the image on the recording medium P discharged, after a fixing process, from the main body of the image forming apparatus 100.

A normal color image forming operation of the image forming apparatus will now be described.

First, the document D is conveyed via conveyance rollers of the document feeder 3 from an original platen in an arrow direction in the figure and is placed on a contact glass 5 of the document reader 4. Then, the document reader 4 optically reads out image information of the document D placed on the contact glass 5.

More specifically, the document reader 4 causes an illumination lamp to emit light onto the image of the document D on the contact glass 5 for scanning. Then, the light reflected by the document D is focused to a color sensor via various mirrors and lenses. The color image information of the document D is read by the color sensor for the light of each separated color of RGB (red, green, and blue) and is converted to electrical image signals. Further, based on the RGB separated-color image signals, an image processor performs color conversion process, color correction process, spatial frequency correction process, and the like, and obtains color image information of yellow, magenta, cyan, and black.

Then, color-image information of yellow, magenta, cyan, and black is sent to the writing section 2. Then, from the writing section 2, laser beams (or exposure light) based on each color image information are emitted toward corresponding photoreceptor drums 11Y, 11M, 11C, and 11BK.

On the other hand, the four photoreceptor drums 11Y, 11M, 11C, and 11BK each rotate in the clockwise direction as illustrated in FIG. 1. The surface of each of the photoreceptor drums 11Y, 11M, 11C, and 11BK is uniformly charged at a position opposite the charger 12. This is a charging process. Then, a charged potential is formed on each of the photoreceptor drums 11Y, 11M, 11C, and 11BK. Thereafter, the charged surface of the photoreceptor drums 11Y, 11M, 11C, and 11BK reaches a position at which the laser beams corresponding to each color are emitted.

In the writing section 2, the laser beams corresponding to the image signals of each color are emitted from four light sources. Each laser beam passes through a different light path for each image component of yellow, magenta, cyan, and black. This is an exposure process.

The laser beams corresponding to the yellow component are irradiated to a surface of the photoreceptor drum 11Y disposed leftmost in FIG. 1. At this time, the laser beams of the yellow component is scanned in the rotary axis direction of the photoreceptor drum 11Y, (that is, in a main scanning direction) by a polygon mirror rotating at a high speed. Thus, on the photoreceptor 11Y charged by the charger 12, an electrostatic latent image corresponding to the yellow component is formed.

Similarly, the laser beams corresponding to the magenta component are irradiated to the surface of the photoreceptor drum 11M disposed at a second position from left in FIG. 1, and an electrostatic latent image corresponding to the magenta component is formed on the photoreceptor drum 11M. Similarly, the laser beams corresponding to the cyan component are irradiated to the surface of the photoreceptor drum 11C disposed at a third position from left in FIG. 1, and an electrostatic latent image corresponding to the cyan component is formed on the photoreceptor drum 11C. Similarly, the laser beams corresponding to the black component are irradiated to the surface of the photoreceptor drum 11BK disposed at a fourth position from left in FIG. 1, and an electrostatic latent image corresponding to the black component is formed on the photoreceptor drum 11BK.

Thereafter, the surfaces of the photoreceptor drums 11Y, 11M, 11C, and 11BK each on which an electrostatic latent image corresponding to each color is formed reach a position opposite the developing device 13. Then, from each developing device 13, toner of each color is supplied to each photoreceptor drum 11Y, 11M, 11C, or 11BK and each latent image on the photoreceptor drums 11Y, 11M, 11C, and 11BK is developed. This is a developing process.

Thereafter, each surface of the photoreceptor drums 11Y, 11M, 11C, and 11BK after the developing process reaches a position opposite the intermediate transfer belt 17. Herein, at each opposed position between the photoreceptor drums and the intermediate transfer belt 17, a transfer bias roller 14 is so disposed as to contact an inner surface of the intermediate transfer belt 17. Then, at a position of the transfer bias roller 14, each toner image formed on the photoreceptor drums 11Y, 11M, 11C, and 11BK is sequentially transferred onto the intermediate transfer belt 17 in the superimposed manner. This is the primary transfer process.

Then, each surface of the photoreceptor drums 11Y, 11M, 11C, and 11BK after the transfer process reaches a position opposite the cleaner 15. Then, the cleaner 15 collects residual toner remaining on the photoreceptor drums 11Y, 11M, 11C, and 11BK. This is the cleaning process.

Thereafter, each surface of the photoreceptor drums 11Y, 11M, 11C, and 11BK passes through a discharger, not shown, at which the charged potential thereon is discharged and a series of imaging processes is completed.

On the other hand, the intermediate transfer belt 17 onto which toner images of respective colors on the photoreceptor drums 11Y, 11M, 11C, and 11BK are transferred in the superimposed manner rotates in the clockwise direction as illustrated in FIG. 1 and reaches a position opposite the secondary transfer bias roller 18. Then, at a position opposite the secondary transfer bias roller 18, the color toner image carried on the intermediate transfer belt 17 is transferred onto the recording medium P. This is the secondary transfer process.

Then, the intermediate transfer belt 17 is rotated further and reaches the intermediate transfer belt cleaner 16. Residual toner deposited on the intermediate transfer belt 17 is collected by the intermediate transfer belt cleaner 16, completing a series of transfer processes related to the intermediate transfer belt 17.

The recording medium P conveyed to a position between the intermediate transfer belt 17 and the secondary transfer bias roller 18, that is, a secondary transfer nip, has been conveyed from either of the sheet feed trays 7 via the registration roller pair 9 and the like. Specifically, the recording medium P is conveyed from the sheet feed tray 7 containing the recording medium P by the sheet feed roller 8, is passed through the conveyance guide, and is guided to the registration roller pair 9. Then, the recording sheet P which has reached the registration roller pair 9 is conveyed to the secondary transfer nip at a predetermined matched timing with the photoreceptor drums 11Y, 11M, 11C, and 11BK. Then, the recording medium P on which the full color toner image has been transferred is guided by the conveyance belt to the fixing device 20. The fixing device 20 fixes the color toner image onto the recording medium P at a nip portion between the fixing belt and the pressure roller.

Then, the recording medium P after the fixing process is discharged as an output image to outside the main body of the image forming apparatus 100 by the displacement of a switching claw as illustrated by a broken-line arrow in FIG. 1 when a "gloss mode" to improve the gloss of the output image is not selected, and a series of image forming operation is completed.

By contrast, when the "gloss mode" is selected, as illustrated by a solid-line arrow in FIG. 1, the recording medium P is guided by the gloss applicator 300 from the main body of the image forming apparatus 100 by a displacement of the switching claw, is applied with glossy property to the image thereon, and is discharged as an output image from the gloss applicator 300 to complete a series of image forming processes.

Herein, the "gloss mode" can be arbitrarily selected by a user operating the control panel of the main body of the image forming apparatus 100, and is selected, for example, when outputting an image like a photographed picture for which high gloss property is required.

Hereinafter, a structure and operation of the gloss applicator will now be described.

Figure 2:
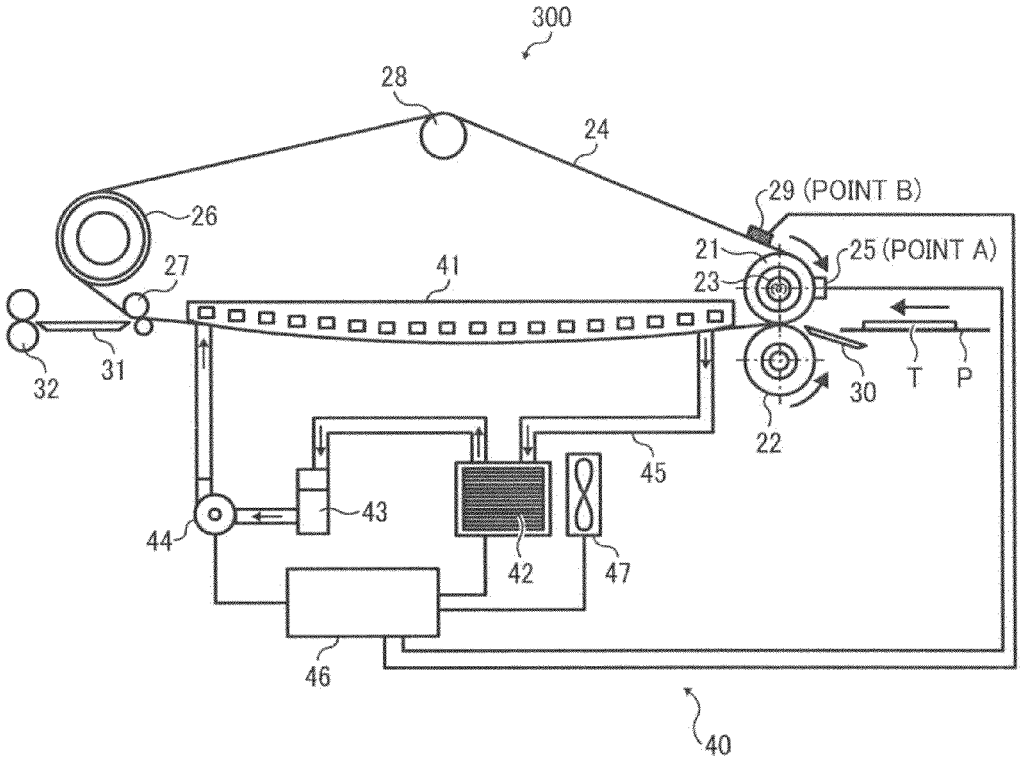
FIG. 2 is a view illustrating an exemplary configuration of the gloss applicator.

FIG. 2 shows a schematic configuration of a gloss applicator. The gloss applicator 300 according to an embodiment of the present invention includes: a halogen heater 23 as a heat source; a gloss applying heat roller (a heating member) 21 heated by the halogen heater 23; a driving roller 26; a separation roller pair 27; a tension roller 28; an endless belt 24 stretched around the gloss applying heat roller 21, the separation roller pair 27, the driving roller 26, and the tension roller 28 and rotating in an arrow direction in FIG. 2 while being heated by the gloss applying heat roller 21; a gloss applying pressure roller 22 that presses against the gloss applying heat roller 21 via the endless belt 24 to form a nip portion; and a cooling unit 40 (including parts 41 to 46). The recording medium P on which a toner image T is formed enters into the nip portion, is conveyed while contacting the endless belt 24 from the nip portion, is cooled by the cooling unit 40, and is separated from the endless belt 24.

The gloss applicator 300 further includes a temperature sensor (or a first temperature sensor) 25 such as a thermistor to detect a temperature of the surface of the endless belt 24. A temperature controller, not shown, controls the halogen heater 23 to be turned on and off based on the detection result of the temperature sensor 25.

The gloss applicator 300 further includes another temperature sensor (or a second temperature sensor) 29 such as a thermistor disposed at an arbitrary position between a separation position (that is, a position of the separation roller pair 27) and a heating position by the gloss applying heat roller 21 in the rotary direction of the endless belt 24, and configured to detect a temperature of the endless belt 24. A cooling controller 46 controls cooling amount of the cooling unit 40 based on the detection result of the temperature sensor 29.

The gloss applying heat roller 21 of the gloss applicator 300 is a cylindrical metal roller and is formed of a highly thermally conductive metal material such as aluminum having an external diameter of from 50 to 120 mm. In addition, the halogen heater 23 is built in a hollow section of the cylindrical body and the gloss applying heat roller 21 is heated by the built-in halogen heater 23.

Both lateral ends of the halogen heater 23 each are fixed to a side plate, not shown, of the gloss applicator 300. The gloss applying heat roller 21 is heated by radiation heat from the halogen heater 23 of which output is controlled by a power supply (such as an AC power supply), not shown in the figure. The endless belt 24 is heated by the gloss applying heat roller 21 and the heat is applied to the toner image T on the recording medium P from the heated surface of the endless belt 24.

The output of the halogen heater 23 is controlled based on the detection result of the surface temperature by the first temperature sensor 25 contacting the surface of the endless belt 24. For example, an alternating-current voltage is applied to the halogen heater 23 during a period of time determined based on the detection result of the first temperature sensor 25. Such a controlled output of the halogen heater 23 allows a surface temperature of the endless belt 24 at a position stretched around the gloss applying heat roller 21 to be controlled and adjusted at a desired temperature, for example, from 100 to 180 degrees C.

With its external diameter of from 50 to 120 mm, the gloss applying pressure roller 22 includes a cylindrical metal roller and an elastic layer (i.e., a silicon rubber layer) formed on an external periphery of the metal roller, and further a surface layer with 30 to 200 μm thick formed of a fluorine resin tube and the like.

In addition, the gloss applying pressure roller 22 is pressed against the gloss applying heat roller 21 via the endless belt 24 by a pressing mechanism, not shown, to form a nip portion for applying glossiness. A width of the gloss applying nip portion is set at substantially 10 to 40 mm.

The endless belt 24 has a two-layered structure and is formed of a base member and a surface layer formed on an external surface of the base member. As a base member, a resin sheet with a high thermal resistance and a thickness of from 10 to 300 μm can be used. Specifically, a polymer sheet formed of polyester, polyethylene, polyethylene-terephthalate, polyether sulphone, polyether ketone, polysulfone, polyimide, polyamide imide, polyamide, and the like. In addition, the surface layer is formed of materials such as silicon resins or fluorine resins with a thickness of from 1 to 100 μm.

Because the endless belt 24 is a member to apply the gloss to the image as described heretofore, the surface of the surface layer is formed as a smooth surface appropriate to apply a high gloss. In this case, the smooth surface is configured to have an average roughness Ra of less than 0.3 μm and more preferably less than 0.1 μm. In addition, the endless belt 24 is driven to rotate at a speed of from 50 to 700 mm/sec by a driving force of the driving roller 26, which is driven by a driving means, not shown.

The cooling unit 40 includes a cooling member 41, a radiator 42, a tank 43, a pump 44, a tube 45, and the cooling controller 46.

Figure 3:
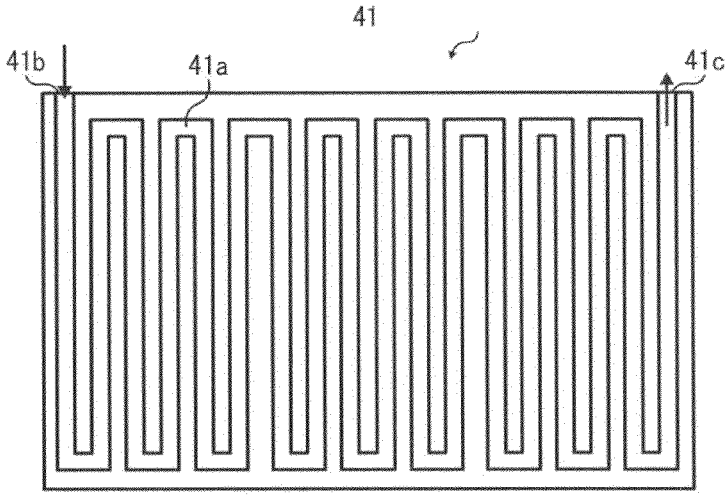
FIG. 3 is a cross-sectional view of a cooling member.

FIG. 3 is a cross-sectional view of the cooling member 41 of FIG. 2 seen from above. The cooling member 41 is formed of a highly thermally conductive metal, such as aluminum, and includes a liquid inside thereof. The liquid is also called a coolant and water is used for example. Inside the cooling member 41, a flow path or groove 41*a* is formed and the liquid reciprocally moves and circulates in the width direction in the groove. As illustrated in FIG. 3, the cooling member 41 includes an inlet 41*b* and an outlet 41*c* of the liquid at both ends thereof. The liquid circulates inside the cooling member 41, thereby cooling the cooling member 41.

The cooling member 41 is disposed downstream of the nip formed by and between the gloss applying heat roller 21 and the gloss applying pressure roller 22 in the conveyance direction of the recording medium P and at an inner surface of the endless belt 24 so as to cool the endless belt 24. With this structure, the toner image T on the recording medium P further conveyed while closely contacting the endless belt 24 can be cooled. In the present embodiment, in order to improve the close contact between the endless belt 24 and the cooling member 41, the cooling member 41 is disposed to press-contact the inner surface of the endless belt 24 over a substantially entire area from the position of the gloss applying heat roller 21 to the separation roller 27.

The pump 44 to circulate the liquid inside the cooling member 41, the radiator 42 to cool the liquid, and the tank 43 to reserve the liquid are disposed and they are connected with each other by the tube 45. Then, in the cooling unit 40, the liquid is circulated in the direction shown by arrows in FIG. 2.

The radiator 42 includes a fan 47 to cool and dissipate heat of the liquid which flows inside the radiator 42. The fan 47 is a cooling adjusting means and is configured to adjust a ventilation air volume in a variable range from 0 to 11 $m^3$/min. The ventilation air volume adjustment of the fan 47 is controlled by a temperature detected by the second temperature sensor 29.

Further, the pump 44 is formed as a flow amount adjusting means to vary the liquid flow amount conveyed from the tank 43 to the cooling member 41 in a range of from 0 to 15 liters/min. The flow amount adjustment of the pump is controlled by the cooling controller 46 based on the detected temperature by the second temperature sensor 29.

The cooling unit 40 does not execute only the above liquid cooling method nor serves as the above system, but the use of the above liquid cooling system enables the cooling unit 40 to cool the endless belt effectively.

As to the recording medium P on which a toner image is fixed in the image forming apparatus 100 as illustrated in FIG. 1, when a high glossiness as in the photographic image is desired, the recording medium P may only be passed through the gloss applicator 200 to improve the glossiness. An example of operation to apply gloss to the toner image by the gloss applicator 300 will now be described.

As illustrated in FIG. 2, the recording medium P onto which the toner image T is fixed is guided by a guide member 30 to the nip formed between the gloss applying heat roller 21 and the gloss applying pressure roller 22 to pass through the nip, and is heated.

When the surface temperature of the endless belt 24 is kept at 170 degrees C. at "Point A" (i.e., the position of the temperature sensor 25), if the recording medium P passes through the nip, the surface temperature of the recording medium P increases to 100 to 120 degrees C. As a result, the toner image T is softened and fused. The recording medium P is conveyed while closely attaching to the endless belt 24 by an adhesive force of the toner image T to the endless belt 24. The recording medium P is cooled by that the endless belt 24 is conveyed while contacting the cooling member 41, and is separated from the endless belt 24 at a position of the separation roller pair 27. Because the thus-cooled toner image T on the recording medium P in a closely attaching state with the endless belt 24 is cooled down to less than 40 degrees C. and solidified when separated from the endless belt 24, a surface state of the endless belt 24 is transferred to the toner image surface, whereby a high gloss can be obtained.

The recording medium P separated from the endless belt 24 is guided by a guide member 31 and is discharged via a discharge roller pair 32 to a sheet ejection tray of the gloss applicator 300.

The glossiness of the image obtained by the gloss applicator 300 was 65 to 80 according to the glossiness at 20 degrees C. In the present embodiment, the temperature when the recording medium P is separated from the endless belt 24 is set at 40 degrees C. or below. However, because the toner image is solidified when the temperature is below 40 degrees C., the glossiness is not improved even though the endless belt 24 is further cooled. In addition, in a low-temperature environment of 10 degrees C., because the apparatus itself is cool when the apparatus has been initialized, temperatures of the cooling member and the coolant are also as low as 10 degrees C.

Control executed by the cooling controller 46 will now be described in detail.

The cooling controller 46 is configured as a part of the controller to control the gloss applicator 300; however, if the image forming apparatus 100 includes the gloss applicator 300, the cooling controller 46 may be configured as a part of the controller of the image forming apparatus 100. The same stands for the temperature controller.

Figure 4:
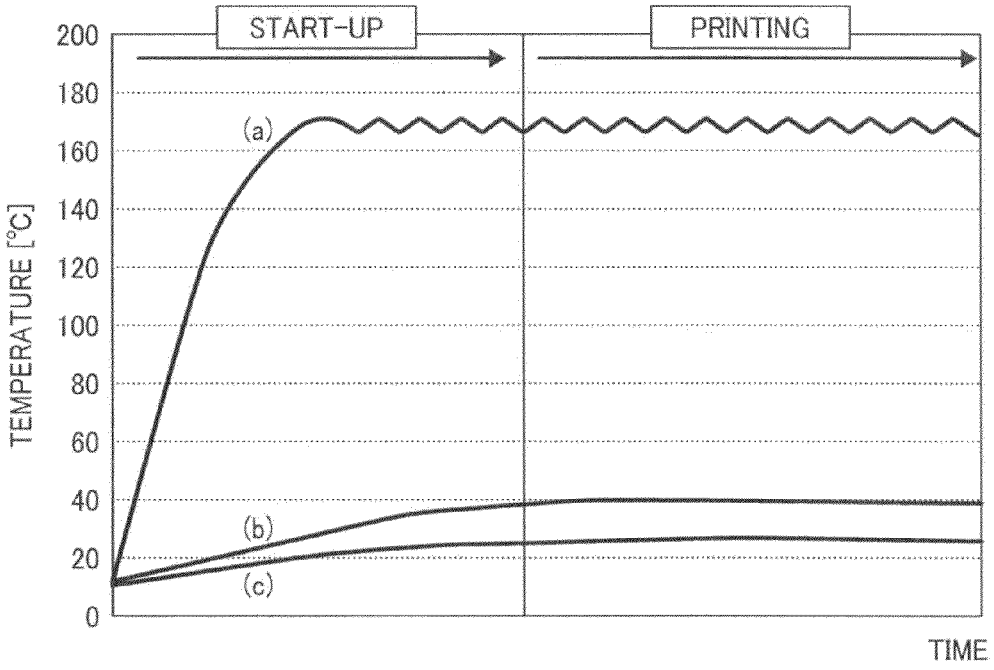
FIG. 4 is a graph illustrating a detected result of temperature of an endless belt at each position (a) to (c) from start-up to printing.

FIG. 4 is a graph illustrating a detected result of the temperature of the endless belt 24 at each temperature sensor when the gloss applicator 300 is started up and then printing is performed. A line (a) shows a surface temperature of the endless belt 24 on the gloss applying heat roller 21 at Point A in FIG. 2 detected by the first temperature sensor 25.

A line (b) shows a surface temperature of the endless belt 24 on the gloss applying heat roller 21 at Point B in FIG. 2 detected by the second temperature sensor 29, in a case in which the cooling amount of the cooling unit 40 is controlled by the cooling controller 46 according to an embodiment of the present invention. On the other hand, a line (c) shows a comparative example in which a surface temperature of the endless belt 24 at Point B in FIG. 2 detected by the second temperature sensor 29, in a case in which the cooling controller 46 is not provided and the cooling amount of the cooling unit 40 is set to a predetermined amount (that is, the temperature of the endless belt 24 after cooling is cooled down to 40 degrees C. or below regardless of the environmental temperature).

As shown by the line (a) of FIG. 4, at start-up of the gloss applicator 300, the halogen heater 23 installed in the gloss applying heat roller 21 causes the surface temperature of the endless belt 24 at Point A detected by the temperature sensor 25 to rise up to 170 degrees C. As shown by the lines (b) and (c), the surface temperature of the endless belt 24 at Point B before heating at the start of start-up is in a low temperature environment and as low as 10 degrees C.

Upon start of start-up, the cooling unit 40 starts cooling the endless belt 24. However, in a case of high-speed apparatus, if the temperature of the gloss applying heat roller 21 rises, the surface temperature of the endless belt 24 after cooling at a position between the separation roller 27 and the gloss applying heat roller 21 gradually increases.

When the temperature detected by the temperature sensor 25 reaches 170 degrees C. and start-up is completed, a continuous printing of 1000 sheets is performed at a speed of 350 mm/sec and 80 sheets/min while the cooling unit 40 cooling the cooling member 41. In this case, if the cooling amount is not controlled (that is, the line (c) in FIG. 4), the surface temperature of the endless belt 24 before heating is 27 degrees C. However, as described above, because the temperature after the heating may only be 40 degrees C. in order to obtain a high gloss image, cooling to be as low as 27 degrees C. is too much and it can be said that it is uselessly cooled.

Figure 5:
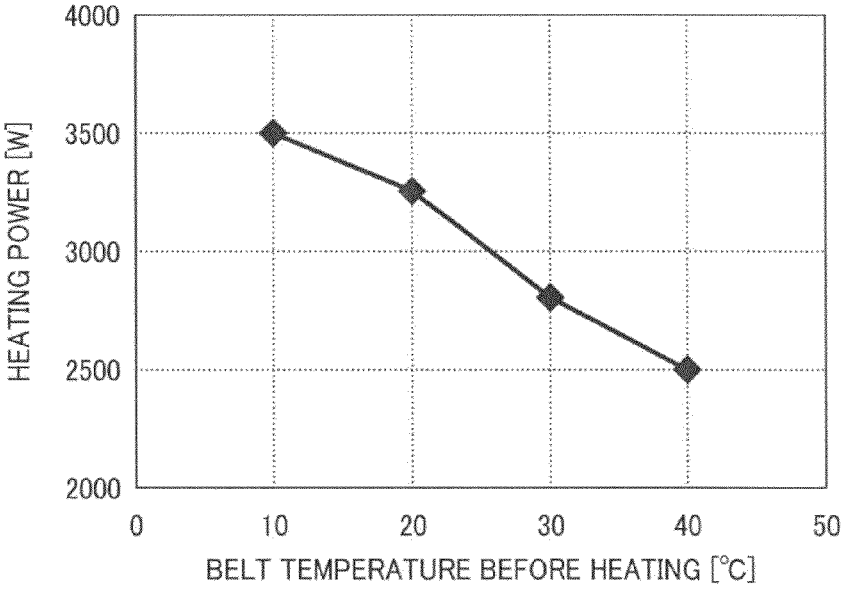
FIG. 5 is a graph representing a relation between the temperature of the endless belt before heating and heating power required for a heater section.

FIG. 5 is a graph representing a relation between the temperature of the endless belt before heating and heating power required for a heater section. The graph shows that the heating power when the surface of the endless belt 24 is cooled down to 27 degrees C. before heating is 2,940 Watts.

Specifically, the cooling amount is not controlled in the line (c) of FIG. 4. Because the printing is performed in the same condition even in the higher temperature environment such as 32 degrees C. so that the temperature of the endless belt 24 after cooling is configured to be cooled down up to 40 degrees C. or less, the endless belt 24 is too-much cooled in the lower temperature environment such as 10 degrees C. and the heating power is increased too much.

By contrast, in the preferred embodiment of the present invention, because the cooling amount of the cooling unit 40 is varied based on the detected temperature by the second temperature sensor 29, the temperature of the endless belt 24 after cooling in the printing operation can be kept at a desired temperature of 40 degrees C.

Specifically, the cooling controller 46 reduces or stops the flow of coolant of the cooling unit 40 based on the detected temperature by the temperature sensor 29 before heating, or alternatively slows the fan 47 to reduce its effectiveness.

As illustrated in FIG. 5, in a case in which the surface temperature of the endless belt 24 before heating is 40 degrees C. and is controlled at an appropriate temperature, the necessary power consumption or heating power for the heater section is 2,500 watts. With such an appropriate control of the temperature by the cooling controller 46 before heating, the power consumption at the heater section can be drastically decreased to 440 watts.

On the other hand, when the detected temperature by the second temperature sensor 29 is higher than the desired temperature, it can be said that the cooling effect of the cooling unit 40 is weakened due to heat radiation from the heater section. Therefore, the cooling controller 46 may control the cooling amount of the cooling unit 40 to increase.

As described above, the gloss applicator 300 according to the present embodiment can control the cooling amount of the cooling unit 40 based on the detected temperature by the second temperature sensor 29 and controls the temperature of the endless belt 24 before heating at an appropriate temperature. Accordingly, when the detected temperature is higher than the desired value, the gloss applicator 300 controls the cooling amount of the cooling unit 40 to increase, thereby improving the cooling effect. Similarly, when the detected temperature in the low-temperature environment is lower than the desired value, the gloss applicator 300 controls the cooling amount of the cooling unit 40 to decrease, thereby eliminating unnecessary cooling and decreasing the electric power required for heating the heater section.

As illustrated in FIG. 2, the second temperature sensor 29 is preferably disposed immediately before the heater section of the endless belt 24, and by controlling the cooling amount based on the detected temperature immediately in front of the heater section, cooling and heating can be performed most efficiently.

Figure 6:
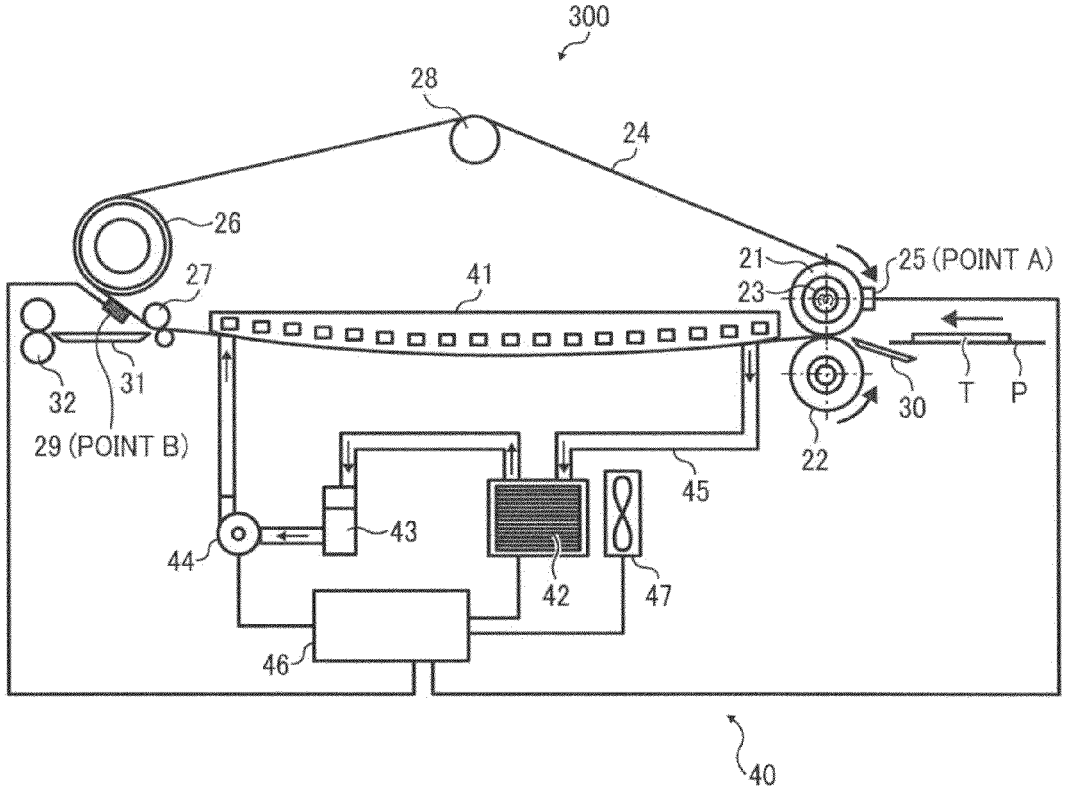
FIG. 6 is a view illustrating another exemplary configuration of the gloss applicator.

FIG. 6 is a schematic view of the gloss applicator 300 in which the second temperature sensor 29 is disposed immediately downstream of the separation roller 27 so as to detect the surface temperature of the endless belt 24 upon the recording sheet being separated from the endless belt 24. As illustrated in FIG. 6, the second temperature sensor 29 can be disposed at any position as long as it is between the separation roller 27 and the gloss applying heat roller 21. As illustrated in FIG. 6, the second temperature sensor 29 is disposed on the endless belt 24 immediately after the recording sheet separating section and the cooling amount is controlled based on the detected temperature immediately after the recording sheet separation, thereby also enabling to cool the endless belt efficiently.

The gloss applicator and the image forming apparatus including the gloss applicator according to the present embodiment can optimally control the cooling unit and the optimal gloss applicator applicable to the high-speed apparatus can be realized.

Additional modifications and variations of the present invention are possible in light of the above teachings. It is therefore to be understood that, within the scope of the appended claims, the invention may be practiced other than as specifically described herein.

What is claimed is:

1. A gloss applicator comprising:

a heat source;

a heater member to be heated by the heat source;

an endless belt to rotate while being heated by the heater member;

a pressure member that presses against the heater member via the endless belt, thereby forming a nip;

a cooling unit to cool the endless belt, wherein a recording medium on which a toner image is formed is conveyed into the nip, and the recording medium is further conveyed from the nip while being in contact with the endless belt to be cooled by the cooling unit and is separated from the endless belt;

a first temperature sensor that detects a surface temperature of the endless belt disposed against the heater member via the endless belt;

a second temperature sensor configured to detect a surface temperature of the endless belt and disposed on the endless belt immediately upstream and away from the heater member so as to be between a separating position of the recording medium and a heating position by the heater member, in the rotation direction of the endless belt; and a cooling controller to control the cooling unit to vary a cooling amount based on the surface temperature detected by the second temperature sensor, wherein the cooling unit includes a cooling member through which a coolant circulates, the cooling member being disposed to press-contact an inner surface of the endless belt, and wherein, during start-up of the gloss applicator, the cooling controller performs a control operation which increases the cooling amount when the surface temperature detected by the second temperature sensor is greater than a predetermined value and which decreases the cooling amount with the surface temperature detected by the second temperature sensor is less than the predetermined value such that the surface temperature of the endless belt is greater than a case in which the cooling unit is not controlled during the start-up of the gloss application and the cooling unit applies a constant cooling amount.

2. The gloss applicator as claimed in claim 1, wherein the second temperature sensor is disposed immediately downstream of the separation position of the recording medium from the endless belt in the rotation direction of the endless belt.

3. The gloss applicator as claimed in claim 1, wherein the cooling unit cools the endless belt via the coolant circulating in the cooling member of the cooling unit.

4. The gloss applicator as claimed in claim 3, wherein the cooling controller controls the cooling unit to vary a flow rate of the coolant in the cooling member of the cooling unit based on the temperature detected by the second temperature sensor.

5. The gloss applicator as claimed in claim 3, wherein the cooling unit includes a fan to cool the coolant and the cooling controller varies a speed of the fan based on the temperature detected by the second temperature sensor.

6. The gloss applicator as claimed in claim 3, wherein the cooling member is a thermally conductive metal member with an internal flow path through which the coolant circulates.

7. The gloss applicator as claimed in claim 6, wherein the metal member is disposed downstream of the nip and is in press-contact with the inner surface of the endless belt over a substantially entire area from a position of the heater member to a separation roller.

8. The gloss applicator as claimed in claim 6, wherein the flow path is formed in the cooling member such that the coolant reciprocally moves and circulates in a width direction in the flow path.

9. An image forming apparatus comprising the gloss applicator as claimed in claim 1.

* * * * *